US008837998B2

(12) United States Patent
Sakaya

(10) Patent No.: US 8,837,998 B2
(45) Date of Patent: Sep. 16, 2014

(54) FIXING DEVICE WITH GUIDE MEMBER HAVING MULTIPLE SPURS AND IMAGE FORMING APPARATUS INCORPORATING SAME

(75) Inventor: Kohta Sakaya, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 648 days.

(21) Appl. No.: 12/588,034

(22) Filed: Oct. 1, 2009

(65) Prior Publication Data

US 2010/0086334 A1 Apr. 8, 2010

(30) Foreign Application Priority Data

Oct. 2, 2008 (JP) ..... 2008-257222

(51) Int. Cl.
*G03G 15/20* (2006.01)

(52) U.S. Cl.
CPC ..... *G03G 15/2085* (2013.01)
USPC ..... 399/322; 399/400

(58) Field of Classification Search
CPC ..... G03G 15/657; G03G 2215/00413; G03G 15/2085
USPC ..... 399/322, 323, 400, 397
See application file for complete search history.

(56) References Cited

U.S. PATENT DOCUMENTS

| | | | | |
|---|---|---|---|---|
| 5,517,292 | A * | 5/1996 | Yajima et al. | 399/323 |
| 5,995,797 | A | 11/1999 | Shigeta et al. | |
| 6,058,278 | A | 5/2000 | Tsuda et al. | |
| 6,058,287 | A * | 5/2000 | Haneda et al. | |
| 2002/0131801 | A1 * | 9/2002 | Tomatsu | 399/400 |
| 2006/0120744 | A1 * | 6/2006 | Shirakata et al. | |
| 2008/0199236 | A1 * | 8/2008 | Hirota | |
| 2009/0110449 | A1 | 4/2009 | Saito et al. | |
| 2009/0129836 | A1 | 5/2009 | Sakaya et al. | |
| 2009/0190949 | A1 | 7/2009 | Hamahashi et al. | |
| 2009/0238585 | A1 | 9/2009 | Hayashi et al. | |

FOREIGN PATENT DOCUMENTS

| | | |
|---|---|---|
| JP | 63-47369 U | 3/1988 |
| JP | H02-097344 | 8/1990 |
| JP | H03-016166 | 2/1991 |
| JP | 5-158367 | 6/1993 |

(Continued)

OTHER PUBLICATIONS

Japanese Office Action dated Nov. 12, 2012 issued for corresponding Japanese Application No. 2008-257222.

*Primary Examiner* — Walter L Lindsay, Jr.
*Assistant Examiner* — Milton Gonzalez
(74) *Attorney, Agent, or Firm* — Harness, Dickey & Peirce, P.L.C.

(57) ABSTRACT

A fixing device includes a fixing nip and a guide member to guide a recording medium transported through a recording media transport pathway to the fixing nip, disposed upstream from the fixing nip in a direction in which the recording medium is transported and facing an unfixed-image side of the recording media. The guide member includes a guide face, the guide face including a first guide face and a second guide face located where at least a trailing-edge of the recording medium approaches the guide member as the recording medium is transported through the recording media transport pathway and which is inclined with respect to the first guide face away from the recording media transport pathway, and a first spur rotatably provided on the guide member and projecting into the recording media transport pathway from a connection portion between the first guide face and the second guide face.

19 Claims, 9 Drawing Sheets

(56) References Cited

FOREIGN PATENT DOCUMENTS

| | | | |
|---|---|---|---|
| JP | 10-142869 | | 5/1998 |
| JP | 11-15287 | | 1/1999 |
| JP | 2000-147979 | | 5/2000 |
| JP | 2001-010754 | | 1/2001 |
| JP | 2001-158549 | | 6/2001 |
| JP | 2002-0132118 | | 5/2002 |
| JP | 2003-270995 | | 9/2003 |
| JP | 2007169034 | A * | 7/2007 |

* cited by examiner

FIXING DEVICE WITH GUIDE MEMBER HAVING MULTIPLE SPURS AND IMAGE FORMING APPARATUS INCORPORATING SAME

CROSS-REFERENCE TO RELATED APPLICATIONS

This patent specification claims priority from Japanese Patent Application No. 2008-257222, filed on Oct. 2, 2008 in the Japan Patent Office, which is hereby incorporated by reference herein in its entirety.

BACKGROUND OF THE INVENTION

1. Field of the Invention

The present invention relates to a fixing device to fix images on recording media, and an image forming apparatus employing the fixing device.

2. Discussion of the Background

In image forming apparatuses, such as printers, facsimile machines, copiers, plotters, or multi-functional peripherals having several of the foregoing functions, fixing devices that fix a toner image on a recording medium such as a paper sheet by heating and pressing the toner image onto the sheet are widely used.

With reference to FIG. 19, configuration of such a fixing device A is described below. As shown in FIG. 19, the fixing device A includes a rotatable fixing roller 100, a heater 200 that heats the fixing roller 100, and a pressure roller 300 that presses against the fixing roller 100. The fixing roller 100 serves as a rotary fixing member, the heater 200 serves as a heating generator, and the pressure roller 300 serves as a rotary pressure member.

A toner image T on a sheet P is fixed by heating and passing the sheet P on which an unfixed toner image T is formed through a fixing nip N103 formed between the fixing roller 100 and the pressure roller 300.

However, before a fixing process to fix the image on the sheet P is performed, a transfer process to transfer the image onto the sheet P must be executed.

An intermediate-transfer type image forming apparatus like that shown in FIG. 19 includes, as a transfer mechanism B transferring the image onto the sheet P, for example, an intermediate transfer belt 400 that carries images, a transfer roller 500, and a facing roller 600.

The transfer roller 500 presses against the facing roller 600 through the intermediate transfer belt 400.

When the image is transferred onto the sheet P, the sheet P is passed through a transfer nip N102 formed between the transfer roller 500 and the facing roller 600, timed to coincide with the rotation of the image on the intermediate transfer belt 400, and then, the image on the intermediate transfer belt 400 is transferred onto the sheet P at the transfer nip N102.

As can be seen from FIG. 19, as the sheet P passes through the transfer nip N102, the sheet P curves along the outer circumferential surface of the facing roller 600. Therefore, depending on the material of the sheet P, after the sheet P is passed through the transfer nip N102, the sheet P is still curved and transported onward in that curved state. The problem is that thereafter, when the curved sheet P is transported to the fixing device A, the sheet P might jam and wrinkle because the sheet P does not enter the fixing nip N103 properly.

To solve this problem, as shown in FIG. 19, two guide members 700 and 800 are located upstream from the fixing nip N103 in a direction in which the sheet P is transported, and these guide members 700 and 800 guide a leading-edge of the sheet P from the transfer nip N102 to the fixing nip N103.

However, when the guide member 700 is located on the side of an unfixed-image surface, that is, a surface of the sheet P on which the unfixed toner image is formed (left side surface in FIG. 19), the guide member 700 contacts the unfixed-image surface, disturbing the image T on the sheet P and thus degrading image quality.

In an effort to avoid this problem, several approaches have been proposed to avoid having the guide member contact the unfixed-image surface of the sheet P.

For example, one known image forming apparatus includes a spur that is rotatably attached to the guide member disposed on the side of the unfixed-image surface of the sheet P. Multiple projections are continuously formed on an outer circumferential surface of the spur. In this case, only a small point of the spur contacts the surface of the transported sheet P, and the sheet P can be prevented from contacting the guide members. Therefore, contact of the unfixed image surface of the sheet P with the guide members and consequent image quality degradation can be prevented.

However, as shown in FIG. 20, when the curved sheet P is transported to the fixing nip N103, due to the rigidity of the curved sheet P, a trailing-edge portion of the sheet P may be curled to such an extent that a portion of the unfixed toner in the trailing-edge portion does contact the guide member 700. In this case, there are concerns that the image on the trailing-edge portion of the sheet P might be disturbed and the image quality might be degraded.

An additional consideration is that, at present, to make the image forming apparatus compact, small-radius rollers are often used for the transfer roller and the facing roller, and the sheet transport pathway itself is often deliberately curved. As a result, situations in which the sheet P transported to the fixing device is curved can increase. Moreover, the known fixing devices do not include a specific mechanism, to prevent the trailing-edge of the curved sheet P from contacting the guide member.

In view of the foregoing, there is market demand for a fixing device capable of preventing the trailing-edge of the sheet P from contacting the guide member, thereby preventing degradation of image quality.

SUMMARY OF THE INVENTION

In view of fore going, one illustrative embodiment of the present invention provides a fixing device that includes a rotary fixing member, a heater to heat the rotary fixing member, a pressure roller that presses against the rotary fixing member to form a fixing nip where the pressure roller presses against the rotary fixing member and through which a recording medium is conveyed to fix an image on the recording medium, a guide member to guide the recording medium transported through a recording media transport pathway to the fixing nip, disposed upstream from the fixing nip in a direction in which the recording medium is transported and facing an unfixed-image side of the recording media, the guide member including a guide face located on a side of the recording media transport pathway, the guide face including a first guide face and a second guide face that is located where at least a trailing-edge of the recording medium approaches the guide member as the recording medium is transported through the recording media transport pathway and which is inclined with respect to the first guide face away from the recording media transport pathway, and a first spur rotatably provided on the guide member and projecting into the recording media transport pathway from a connection portion between the first guide face and the second guide face.

Another illustrative embodiment of the present invention provides an image forming apparatus that includes an image carrier to carry a latent image on its surface, a charging mechanism to electrically charge the surface of the image carrier, an exposure mechanism to expose the surface of the image carrier to form the latent image, a development mechanism to form a visible image by supplying toner to the latent image formed on the surface of the image carrier, a transfer mechanism to transfer the visible image formed on the surface of the image carrier onto a recording media, and the fixing device described above, to fix a transfer image transferred onto the recording media.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
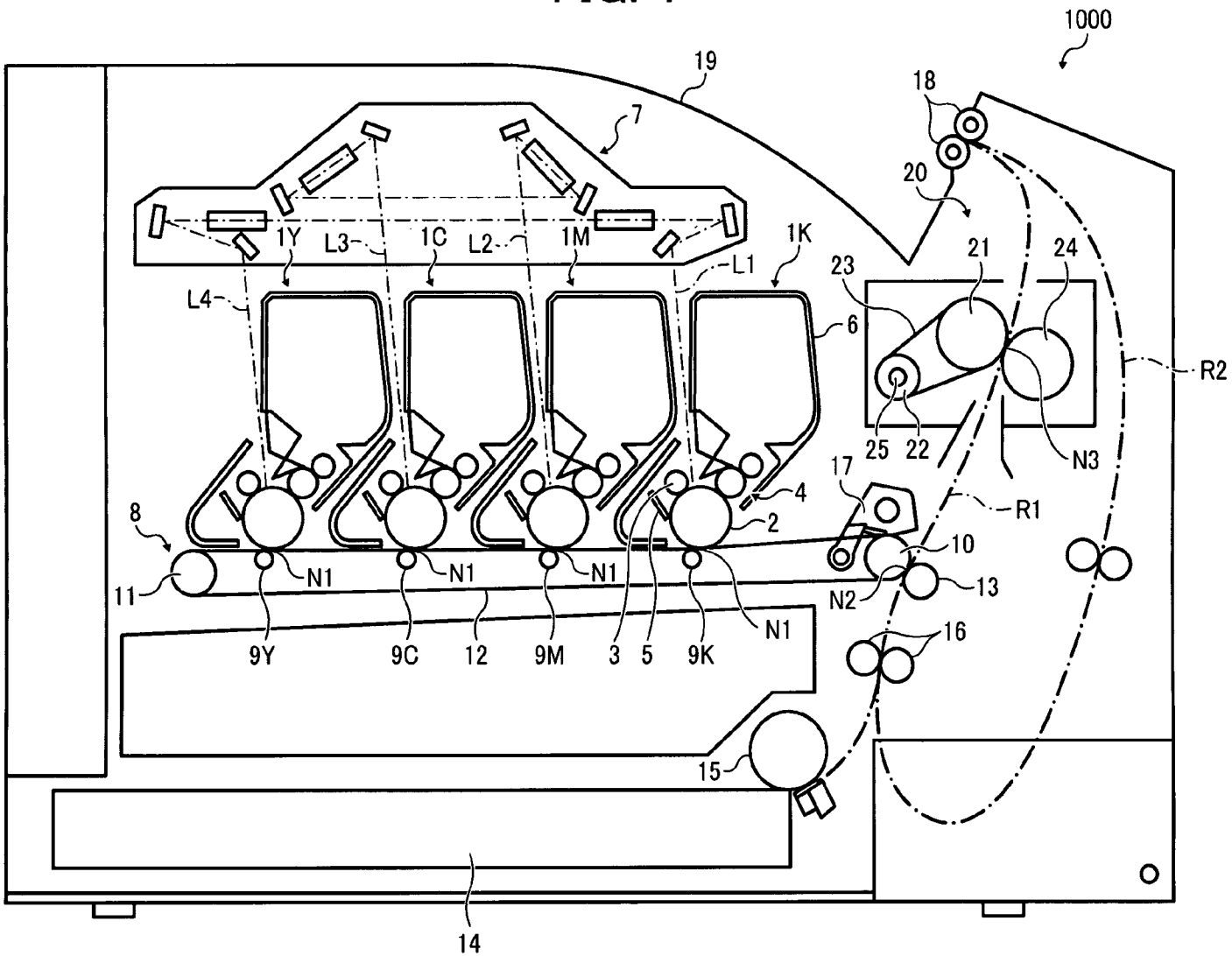
FIG. 1 is a schematic diagram illustrating a configuration of an image forming apparatus including a fixing device according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIG. 1, an image forming apparatus 1000 according to a first embodiment of the present invention is described below.

It is to be noted that although the image forming apparatus 1000 of the present embodiment is a printer, the image forming apparatus 1000 of the present invention is not limited thereto.

(Configuration of Image Forming Apparatus)

FIG. 1 is a schematic diagram illustrating a configuration of the image forming apparatus 1000. An essential portion thereof is described below.

The image forming apparatus 1000 includes four process cartridges 1K, 1M, 1C, and 1Y as image forming units for forming respective single-color toner images corresponding to black, magenta, cyan, and yellow toners. The process cartridges 1K, 1M, 1C, and 1Y are removably installable to the image forming apparatus 1000.

It is to be noted that the subscripts K, M, C, and Y attached to the end of each reference numeral indicate only that components indicated thereby are used for forming yellow, magenta, cyan, and black images, respectively, and hereinafter may be omitted when color discrimination is not necessary.

Each process cartridge 1K, 1M, 1C, and 1Y has a similar configuration except the color of toner used therein. Using the process cartridge 1K as an example, the configurations of the process cartridges 1K, 1M, 1C, and 1Y are described below.

The process cartridge 1K includes an image carrier 2, a charging device 3, a development device 4, and a cleaning member 5 in its exterior frame 6.

The image carrier 2 carries electrostatic latent image on its outer circumferential surface. The charging device 3 electrically charges the outer circumferential surface of the image carriers 2. The development device 4 supplies the toner to the electrostatic latent image carried on the outer circumferential surfaces of the image carrier and forms images. The cleaning member 5 removes residual toner adhering to the outer circumferential surface of the image carrier 2 after a transfer process.

An exposure mechanism 7 is located above the process cartridges 1. The exposure mechanism 7 includes laser light sources, not shown, such as laser diodes and the laser light sources irradiate the respective image carriers 2 with laser beams L1 though L4 in accordance with image data.

Additionally, a transfer unit 8 is located beneath the process cartridges 1. The transfer unit 8 transfers the toner images from the image carrier 2 onto a sheet P, that is, a recording medium, in the transfer process.

The transfer unit 8 includes an intermediate transfer belt 12 that is extended around a driving roller 10 and a driven roller 11, four primary transfer rollers 9K, 9M, 9C, and 9Y that face the respective image carriers 2, and a secondary transfer roller 13 that faces the driving roller 10.

Further, a belt-cleaning device 17 that removes residual toner adhering to a surface of the intermediate transfer belt 12 is disposed on the intermediate transfer belt 12.

Four primary transfer rollers 9K, 9M, 9C, and 9Y are located inside a loop formed by the intermediate transfer belt 12, and face and press against the respective image carriers 2 via the intermediate transfer belt 12. Primary transfer nips N1 in which the images on the image carriers 2 are transferred to the intermediate transfer belt 12 are formed in the respective pressure-contact portions where the four primary transfer rollers 9K, 9M, 9C, and 9Y press against the respective image carriers 2 through the intermediate transfer belt 12.

Further, the secondary transfer roller 13 contacts and presses against the driving roller 10 via the intermediate transfer belt 12, forming a secondary transfer nip N2 to transfer the image on the intermediate transfer belt 12 to the sheet P in the pressure-contact portion.

A fixing device 20 that fixes the image transferred onto the sheet P thereon is disposed above the secondary transfer nip N2 in FIG. 1. The fixing device 20 includes a fixing roller 21, a heating roller 22 inside which a heater 25 serving as a heating device is provided, a fixing belt 23 servings a rotary fixing member that is extended around the fixing roller 21 and the heating roller 22, and a pressure roller 24 disposed opposite the fixing roller 21 and serving as a rotary pressing member to press against the fixing belt 23. In a portion where the pressure roller 24 and fixing belt 23 contact each other with pressure, a fixing nip N3 is formed so that an unfixed toner image is fixed on the sheet P.

In a lower portion of the image forming apparatus 1000, a sheet feed cassette 14 capable of containing multiple sheets P and a feed roller 15 that sends the sheets P from the sheet feed cassette 14 are disposed.

It is to be noted that the sheet feed cassette 14 can contain not only paper sheets but also other recording media such as overhead projection (OHP) film sheets.

In the image forming apparatus 1000, a sheet transport pathway R1 though which the sheet P is transported from the sheet feed cassette 14 upward in FIG. 1 is formed as shown in FIG. 1. Further, a pair of registration rollers 16 that stops the sheet P upstream from the secondary transfer nip N2 in a direction in which the sheet P is transported (hereinafter "sheet transport direction") is disposed on the sheet transport pathway R1. At an exit of the sheet transport pathway R1, a pair of discharge rollers 18 that discharges the sheet P outside is disposed. A discharge tray 19 to which finished sheets P are discharged after image formation and fixing is disposed on the topside of the image forming apparatus 1000.

The image forming apparatus 1000 according to the present embodiment has a mechanism to form images on both sides of the sheet P in a single printing.

More specifically, a sheet reverse pathway R2 to reverse the sheet P while the sheet P is transported though it is formed in the image forming apparatus 1000.

The sheet reverse pathway R2 bifurcates from the sheet transport pathway R1 near the exit thereof and converges with the sheet transport pathway R1 upstream from the registration rollers 16 in the sheet transport direction. The discharge rollers 18 usually rotate in a direction in which the sheet P is discharged outside, and in order to switch the sheet P back to the sheet reverse path R2, the discharge roller is reversely rotatable against the usual rotation direction.

Basic operation of the image forming apparatus 1000 is described below with reference to FIG. 1, taking the process cartridge 1K as an example.

Initially, the charging device 3K uniformly charges the surface of the image carrier 2K to a high potential. Based on the image data, the exposure mechanism 7 emits the laser beam L1 onto the surface of the image carrier 2K. As a result, the electric potential of that portion of the image carrier 2K that is irradiated by the laser beam L1 decreases, thus forming an electrostatic latent image on the image carrier 2K. The developing device 4K then supplies electrostatically charged toner to the electrostatic latent image to form a black toner image (visible image) on the surface of the image carrier 2K.

A voltage controlled to a polarity opposite a charging polarity of the toner is applied to the primary transfer roller 9K, and a transfer electric field is formed in the transfer nip N1. Then, due to the action of the transfer electric field, the toner image on the image carrier 2K is firstly transferred to the rotating intermediate transfer belt 12.

Other process unit 1M, 1C, and 1Y, similarly to description above, respectively form magenta, cyan, and yellow toner images on the images carriers 2, and then, the toner images are firstly transferred onto the intermediate transfer belt 12 sequentially so that the four single-color toner images are superimposed one on another thereon, forming a multicolor toner image.

Meanwhile, the feed roller 15 is rotated in accordance with a feeding signal from a control portion, not shown, in the image forming apparatus 1000. Only a single sheet P is separated from the stack of the sheets contained in the sheet feed cassette 14 from the top, so that each sheet P can be fed one by one. The sheet P thus fed is once stopped by the registration rollers 16.

After each of the single-color toner images is transferred onto the intermediate transfer belt 12 forming the multicolor toner image, the registration rollers 16 restart rotating, and the sheet P is transported to the secondary transfer nip N2 and timed to coincide with (that is, synchronized with) the arrival of the multicolor toner image formed on the intermediate transfer roller 12.

At the secondary transfer nip N2, a voltage having a polarity opposite the charging polarity of the toner is applied to the secondary transfer roller 13, and thus the transfer electric field is formed. Alternatively, a voltage having homopolarity to the charging polarity of the toner may be applied to the driving roller 10 provided to face the secondary transfer roller 13 across the sheet transport path R1 to form a similar transfer electric field. Then, due to the action of the transfer electric field formed at the secondary transfer nip N2, the toner images superimposed on the intermediate transfer belt 12 are collectively secondarily transferred onto the sheet P.

It is to be noted that a small amount of toner (e.g., residual toner) can remain on the surface of each image carrier 2 after primary transfer operation and on the intermediate transfer belt 12 after secondary transfer operation, and the residual toner on each image carrier 2 and that on the intermediate transfer belt 12 are respectively removed by the cleaning member 5 and the belt-cleaning device 17.

After the secondary transfer operation, the sheet P is transported to the fixing device 20. While the sheet P is passing though the secondary transfer nip N2, the toner image is fixed on the sheet P with heat and pressure. Then, the sheet P on which the toner image is fixed is discharged from the fixing device 20. Thereafter, the sheet P is discharged from the image forming apparatus 1000 by the discharge rollers 18 and stacked on the discharge tray 19.

Additionally, when an image is formed on both sides of the sheet P, after the toner image is fixed on one side (e.g., front side) of the sheet P as described above, the discharge rollers 18 begin rotating in reverse to the rotation direction when the sheet P is discharged, and the sheet P is switch backed to the sheet reverse pathway R2. Then, the sheet P is turned over.

Then, similarly to the above-described operation, after the toner image is transferred onto the other side (e.g., back side) of the sheet P and fixed thereon, the sheet P is discharged to the discharge tray 19.

Next, a configuration of a fixing device according to the present embodiment is described below.

Figure 2:
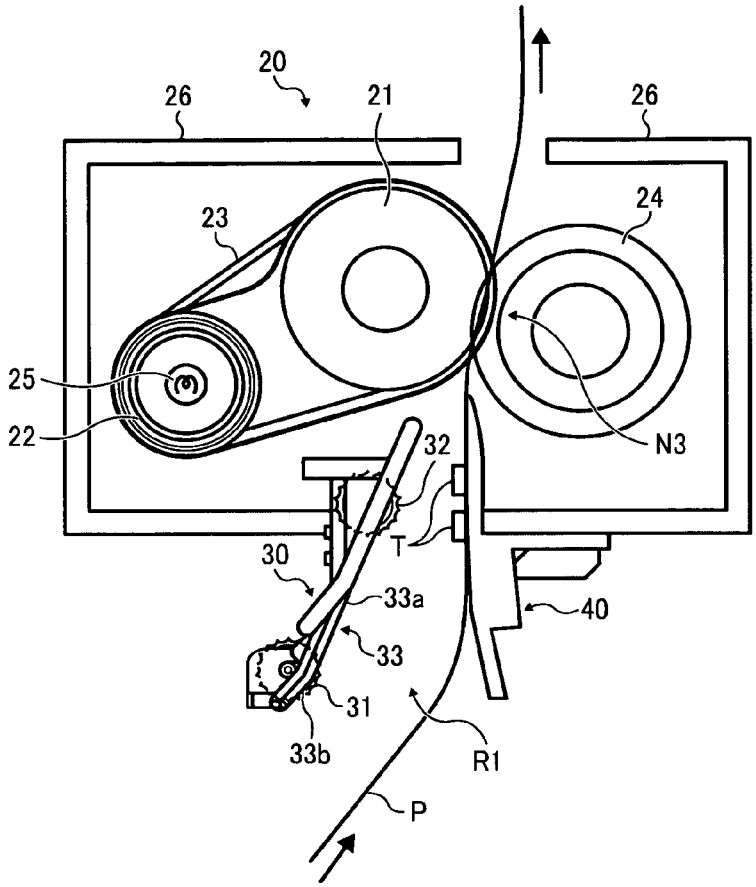
FIG. 2 is a schematic view illustrating a configuration of the fixing device shown in FIG. 1.

FIG. 2 is a schematic view illustrating a configuration of the fixing device 20 according to an illustrative embodiment. In FIG. 2, the fixing device 20 includes the fixing roller 21, the heating roller 22, the fixing belt 23, the pressure roller 24, a case 26 containing these components, and two guide members 30 and 40 integrally provided on the case 26. It is to be noted that the fixing device 20 is removably installable in the image forming apparatus 1000.

The fixing roller 21 is formed of a base metal made of, for example, aluminum or iron. In order to enhance fixing power, the fixing roller 21 can include an elastic layer on the outer circumferential surface, of the base metal, which may be formed of silicone rubber or the like whose thickness is under 1 mm.

The pressure roller 24 includes a base metal, an elastic layer, and a releasing layer. The base member can be made of, for example, aluminum or iron. The elastic layer can be made of, for example, a fluid-type silicone or a foamed-type silicon, and is formed on an outer surface of the base metal. The thickness thereof may be approximately 2 mm to 5 mm. The releasing layer can be made of, for example, PFA (tetra fluoro ethylene-perfluoro alkyl vinyl copolymer) or PTFE (polytetra fluoro ethylene resin) formed on an outer surface of the elastic layer.

Bearings, not shown, rotatably holding both axial end portions of the base member of the pressure roller 24, respectively, are supported on side plates, not shown, movable in a direction close to and away from the fixing roller 21.

Because the pressure roller 24 is pressed by a spring, not shown, toward the fixing roller 21, the pressure roller 24 presses against a surface of the fixing roller 21. Further, when the sheet P is jammed in the fixing nip N3, the pressure roller 24 is moved away from the fixing roller 21, and therefore the jammed sheet P can be removed.

The fixing belt 23 includes a base member, an elastic layer provided on the base member, and a releasing layer provided on the elastic layer. The base member can be formed of resin, for example, polyimide, whose thickness is 50 μm to 150 μm. The elastic layer can be formed of, for example, silicone rubber, whose thickness is 20 μm to 50 μm. The leasing layer can be formed of, for example, PFA, PTFE, or FEP (fluorinated ethylene propylene resin), whose thickness is 20 μm to 50 μm.

Alternatively, in order to reduce the heat capacity of the fixing belt 23, the fixing belt 23 may consist of a resin member or a metal member, such as stainless steel.

As shown in FIG. 2, the two guide members 30 and 40 are located facing each other across the sheet transport pathway R1, beneath the upstream side in the direction in which the sheet P is transported.

The guide member 30 is located facing the front-side of the sheet P on which the unfixed toner image is formed and hereinafter referred to as the front-side guide member 30. The guide member 40 is located facing the back side of the sheet P and, hereinafter referred to as the backside guide member 40.

Spurs 31 and 32 each of which has a large number of projections formed in series on its outer circumferential surface are rotatably provided in a front-side on the upstream side and the downstream side respectively of the front-side guide member 30 in the sheet transport direction, hereinafter also referred to as the upstream spur 31 and the downstream spur 32. It is to be noted that the upstream side and the downstream side represent the upstream side and the downstream side in the direction in which the sheet P is transported unless otherwise specified.

The upstream spur 31 and the downstream spur 32 project from a guide face 33 of the front-side guide member 30 on the side of the sheet transport pathway R1. The upstream spur 31 serves as a first spur and the downstream spur 32 serves as a second spur.

In order to reduce the effect of the spurs 31 and 32 on the unfixed image on the sheet P, tips of the projections formed on the outer circumferential surfaces of the spurs 31 and 32 are preferably curved and have a curvature radius under 0.1 mm. Further, for a similar reason, thickness of the tips of each projection thereof is preferably under 0.3 mm.

Further, because the respective members included in the fixing device 20 are heated, the spurs 31 and 32 respectively provided on the upstream side and downstream side are preferably formed of heat-resistant resin, such as, a PBT (Polybutylene terephthalate), PET, or liquid crystal polymer. Alternatively, the spurs 31 and 32 may be formed of a metal plate. However, for safe handling the spurs 31 and 32 are preferably formed of the heat-resistant resin.

As shown in FIG. 2, the guide face 33 of the front-side guide member 30 includes a first guide face 33*a* and a second guide face 33*b* that is continuous with the first guide face 33*a* and is inclined at a different angle from that of the first guide face 33*a*. The second guide face 33*b* is located in a portion where at least the trailing-edge of the sheet P closes.

Figure 3:
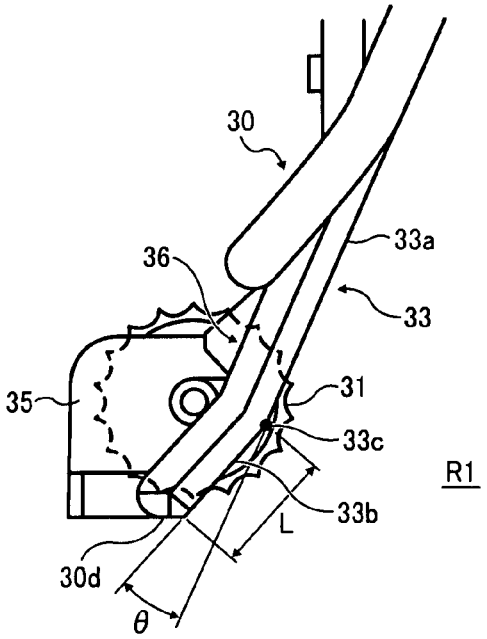
FIG. 3 is an expanded view of an essential portion of the fixing device shown in FIG. 2.

FIG. 3 is an expanded view of the front-side guide member 30. As shown in FIG. 3, the second guide face 33*b* is inclined away from the sheet transport pathway R1, toward left side in FIG. 3, as compared to the first guide face 33*a*. A length L in the sheet transport direction of the second guide face 33*b* and an incline angle (angular difference) θ between the incline angle of the first guide face 33*a* and the incline angle of the second guide face 33*b* should be set so that the leading-edge of the sheet P does not contact the second guide face 33*b*.

Further, the upstream spur 31 projects to the sheet transport pathway R1 from a connection portion (apex) 33*c* between the first guide face 33*a* and the second guide face 33*b*.

In FIG. 3, reference characters 30*d* represent an upstream end portion of the front-side guide member 30, 35 represents a protection wall, and 36 represents a back-side guide face.

A projection amount d1 that is an amount or length of the upstream spur 31 projecting from the second guide face 33*b* to the sheet transport pathway R1 is described with reference to FIG. 4.

Figure 4:
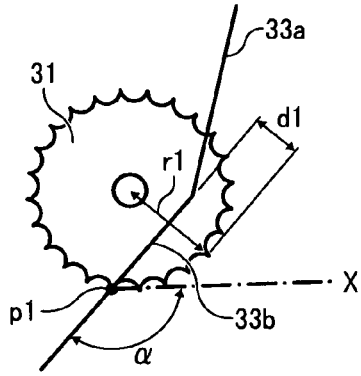
FIG. 4 is a diagram illustrating a projection amount of an upstream spur of the fixing device.

As show in FIG. 4, the projection amount d1 by which upstream spur 31 projects is set shorter than a radius r1 of the upstream spur 31. Further reference numeral p1 represents an intersection between the first guide face 33*a* and the second guide face 33*b*, and referent numeral α represents an angle between the second guide face 33*b* and a tangent line X to the spur 31 at the intersection p1.

In this condition, when the angle α is larger than 90 degrees (obtuse angle), the projection amount d1 of the upstream spur 31 is smaller than the radius r1 thereof.

Figure 5A:
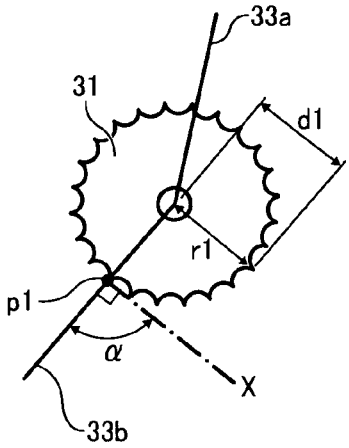
FIGS. 5A and 5B are diagrams illustrating projection amounts of the upstream spur, compared with the projection amount shown in FIG. 4.

By contrast, as shown in FIG. 5A, when the angle α between the second guide face 33*b* and the tangent line X is 90 degrees (right angle), the projection amount d1 by which the upstream spur 31 projects is the same as the radius r1 thereof, and thus the projection amount d1 is not smaller than the radius r1 thereof.

Figure 5B:
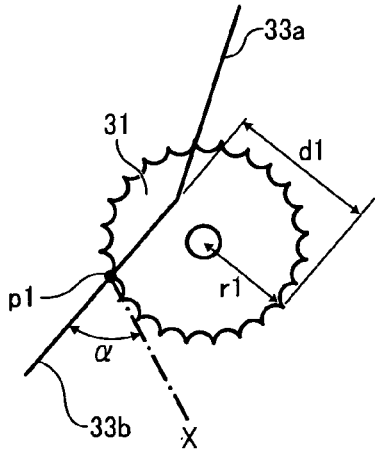

Further, as shown in FIG. 5B, when the angle α between the second guide face 33*b* and the tangent line X is smaller than 90 degrees (acute angle), the projection amount d1 by which the upstream spur 31 projects is larger than the radius r1 thereof.

Meanwhile, the downstream spur 32 projects to the sheet transport pathway R1 from a portion where the first guide surface 33*a* may contact the surface of the sheet P on which, the unfixed toner image is formed.

Figure 6:
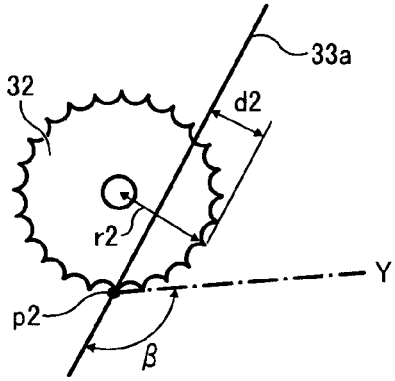
FIG. 6 is a diagram illustrating a projection amount of a downstream spur of the fixing device.

A projection amount d2 that is an amount or length of the downstream spur 32 projecting from the first guide face 33*a* to the sheet transport pathway R1 is described with reference to FIG. 6. In FIG. 6, reference numeral p2 represents an intersection between the first guide face 33*a* and the second guide face 33*b*, and reference numeral β represents an angle between the first guide face 33*a* and a tangent line Y to the downstream spur 32 from the intersection p2.

As shown in FIG. 6, the projection amount d2 that the downstream spur 32 projects is set shorter than a radius r1 of the downstream spur 32.

In this condition, when the angle β is larger than 90 degrees (obtuse angle), the projection amount d2 of the downstream spur 32 is smaller than a radius r2 thereof.

Figure 7A:
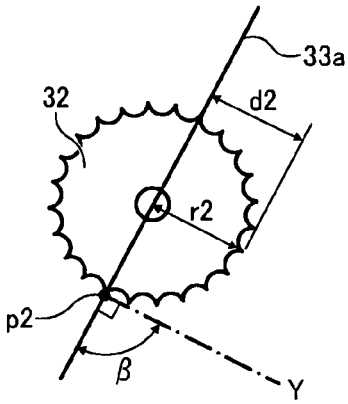
FIGS. 7A and 7B are diagrams illustrating projection amounts of the downstream spur, compared with the projection amount shown in FIG. 6.

By contrast, as shown in FIG. 7A, when the angle β between the first guide face 33*a* and the tangent line Y is 90 degrees (right angle), the projection amount d2 by which the downstream spur 32 projects is the same as the radius r2 thereof, and thus the projection amount d2 is not smaller than the radius r2 thereof.

Figure 7B:
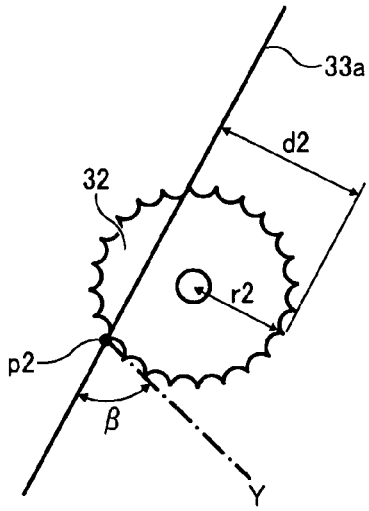

Further, as shown in FIG. 7B, when the angle β between the first guide face 33*a* and the tangent line Y is smaller than 90 degrees (acute angle), the projection amount d2 by which the downstream spur 32 projects is larger than the radius r2 thereof.

Additionally, as shown in FIG. 3, the upstream end portion 30*d* of the front-side guide member 30 is located upstream from the upstream spur 31. By disposing the upstream end portion 30*d* of the front-side guide member 30 as described above, the spur 31 is protected against a direct impact from the upstream side.

Further, the protection wall 35 that projects to a direction opposite the sheet transport pathway R1 is provided on a back-side guide face 36 of the front-side guide member 30 located opposite the front-side guide face 33. The protection wall 35 is located close to the upstream spur 31, and the upstream spur 31 is protected against a direct impact from the direction opposite the sheet transport pathway R1.

Figure 8:
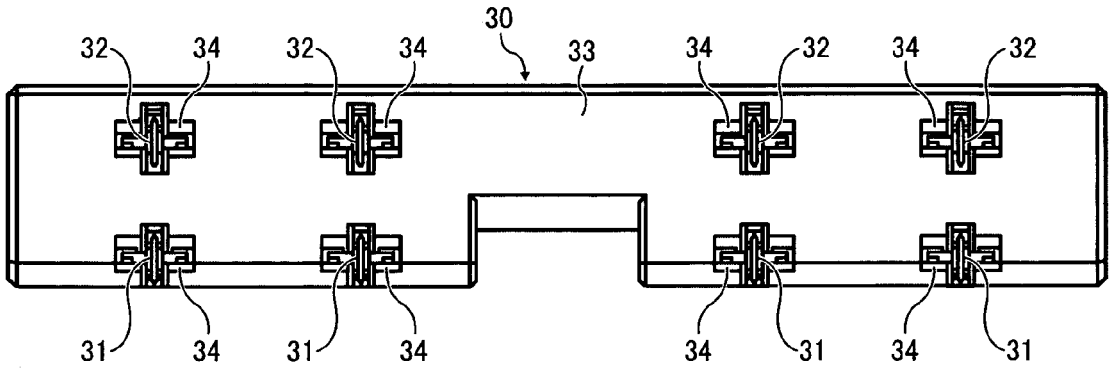
FIG. 8 illustrates a front-side guide member viewed from a guide face.

FIG. 8 illustrates the front-side guide member 30 viewed from the guide face 33. As shown in FIG. 3, the multiple spurs 31 and 32 are arranged orthogonal to the sheet transport direction, namely, sheet width direction (vertical direction in FIG. 8).

Although the spurs 31 and 32 make two rows in the sheet transport direction, and the each of the spurs 31 and 32 makes four rows in the sheet width direction in the configuration shown in FIG. 8, the number of the spurs 31 and 32 is not limited to this configuration.

Additionally, multiple openings 34 to attach the spurs 31 and 32 thereto by insertion are formed in the front-side guide member 30.

Figure 9:
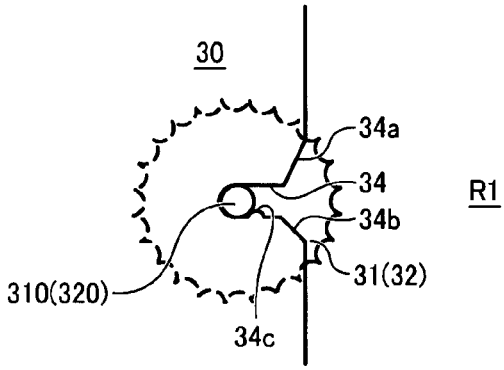
FIG. 9 is a cross-sectional view illustrating an opening formed in the front-side guide member shown in FIG. 8.

FIG. 9 is an enlarged view illustrating the opening 34 formed in the front-side guide member 30. The opening 34 opens opening to the side of the sheet transport pathway R1, and an upstream edge and a downstream edge of the opening are respectively formed by sloped faces 34*a* and 34*b* that incline and face the sheet transport pathway R1. In the opening 34, convex portion 34*c* is formed where each of the spur 31 or 32 is inserted to prevent the axis 310 of the spur 31 or the axis 320 of the spur 32 from coming off.

Next, operation and effect of the fixing device according to the present embodiment is described below.

Figure 10:
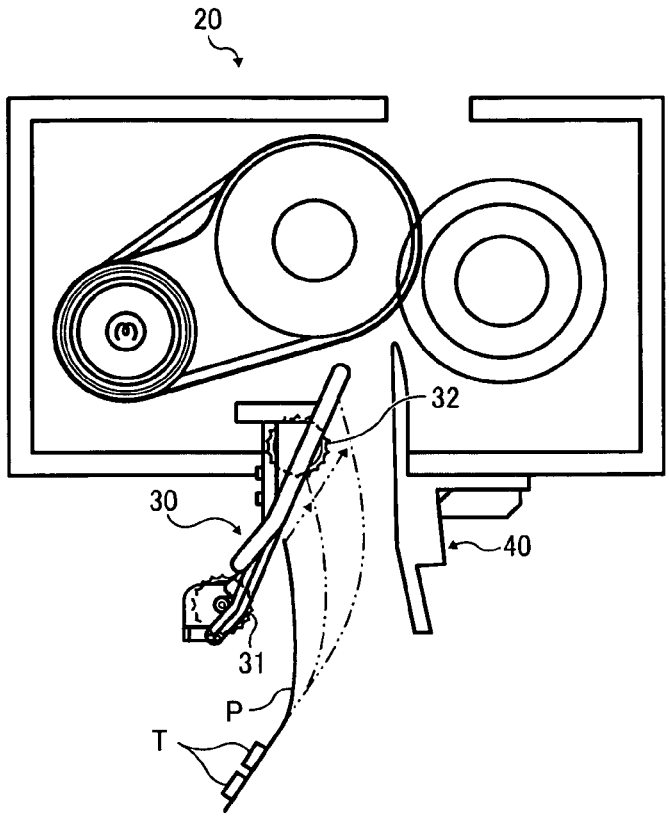
FIG. 10 is an end-on cross-sectional view illustrating the action of the fixing device shown in FIG. 2.

FIG. 10 is an end-on cross-sectional view illustrating the action of the fixing device. As shown in FIG. 10, when the curved sheet P is transported from the secondary transfer nip N2, not shown in FIG. 10, to the fixing device 20 upward, the leading-edge of the sheet P contacts the front-side guide member 30. Then, the sheet P is transported along the front-side guide member 30 downstream in the sheet transport direction as indicated by dashed lines shown in FIG. 10.

At this time, although the leading-edge of the sheet P contacts the front-side guide member 30, the surface of the sheet P on which the unfixed image T is formed does not contact the front-side guide member 30. Therefore, the image quality is not degraded.

Further, when the leading-edge of the sheet P moves along the front-side guide member 30, the leading-edge of the sheet P contacts the downstream spur 32. However, because the downstream spur 32 rotates in the same direction as the direction in which the sheet P is transported as the sheet P moves, the downstream spur 32 does not obstruct the movement of the leading-edge of the sheet P. As described above with reference to FIG. 6, this action can be attained by setting the projection amount d2 less than the radius r2 of the spur 32.

By contrast, with reference to FIGS. 7A and 7B, if the projection amounts d2 of the spur 32 are set equal to or more than the radius of the spur 32, when the leading-edge of the sheet P contacts the spur 32 the spur 32 may fail to rotate smoothly in the same direction as the direction in which the sheet P is transported or may rotate reversely. Therefore, there are concerns that sheet P might be jammed and become wrinkled.

Additionally, depending on the degree of curvature of the sheet P, the leading-edge of the sheet P may contact the upstream spur 31. In this case, the operation and effect of the upstream spur 31 are similar to the above-described operation and effect of the downstream spur 32, and therefore descriptions are omitted.

Figure 11:
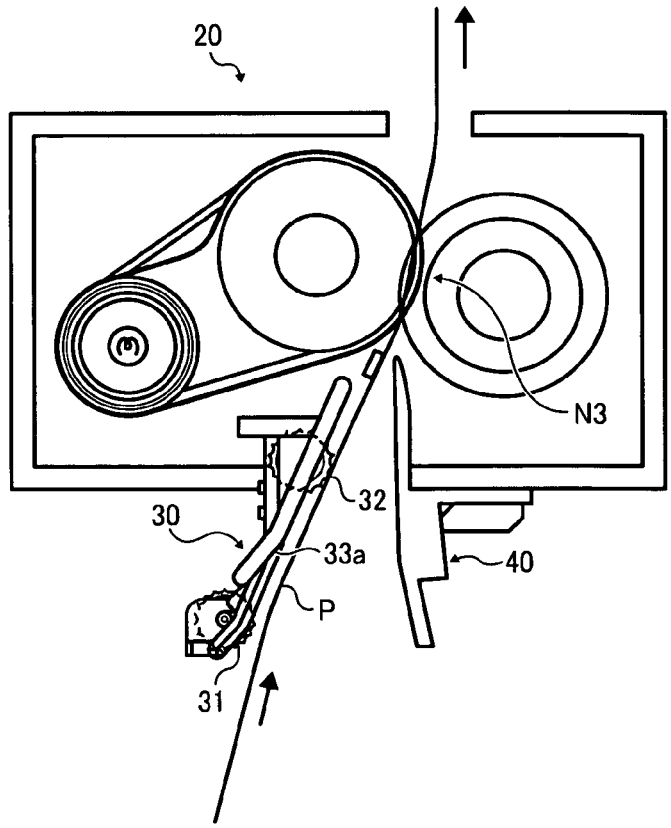
FIG. 11 is an end-on cross-sectional view illustrating the action of the fixing device shown in FIG. 2.

FIG. 11 is a diagram illustrating the action of the fixing device 20 while the sheet P passes through the fixing-nip N3.

In FIG. 11, the leading-edge of the sheet P is sandwiched in the fixing nip N3, and the trailing-edge thereof is sandwiched in the secondary transfer nip N2, not shown in FIG. 11.

While the sheet P sandwiched in both the fixing nip N3 and the secondary transfer nip N2 is transported, the surface of the sheet P on which the unfixed toner image T is formed approaches the first guide face 33*a* of the front-side guide member 30. In this embodiment, because the spur 32 projects from the first guide face 33*a*, the sheet P contacts not the first guides face 33*a* but the spur 32.

Then, as the sheet P is transported downstream, the spur 32 rotates in the same direction as the direction in which the sheet P is transported. At this time, only a small point or small face of the spur 32 contacts the surface of the sheet P on which the unfixed image T is formed, and as a result, the image quality is not degraded.

Figure 12:
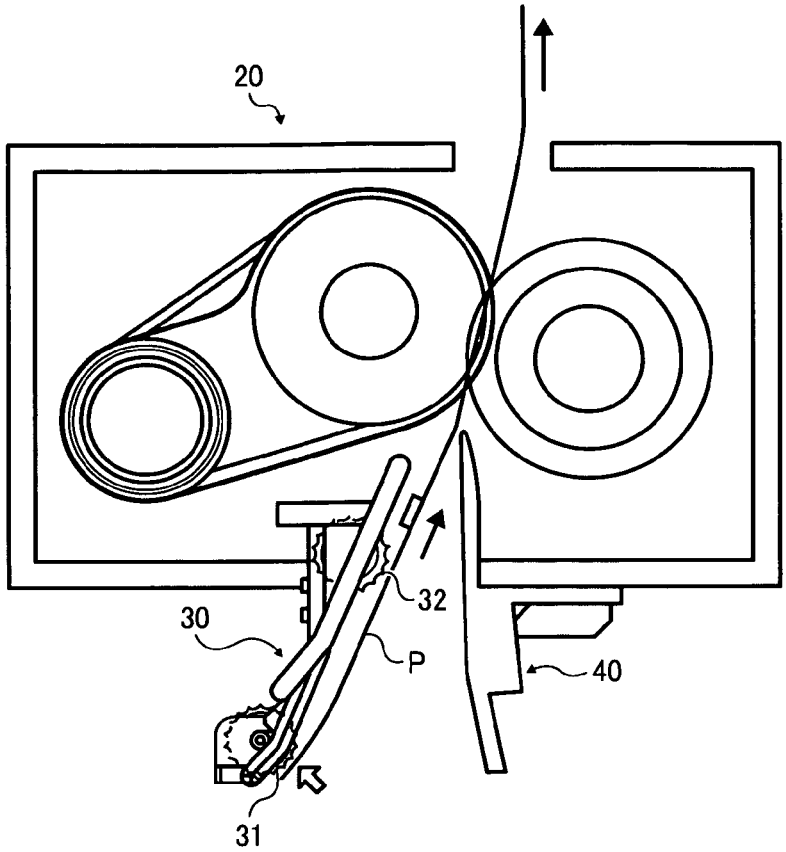
FIG. 12 is an end-on cross-sectional view illustrating the action of the fixing device shown in FIG. 2.

Thereafter, the sheet P is transported downstream, and the trailing-edge of the sheet P exits the secondary transfer nip N2. At this time, as shown in FIG. 12, due to rigidity of the strength of the curved sheet P, the trailing-edge of the sheet P may be curled as it approaches the front-side guide member 30.

In view of the foregoing, in the present embodiment, the second guide face 33*b* that inclines to the direction away from the sheet transport pathway R1 is located at least at a portion which the trailing-edge of the sheet P approaches, and as a result, the trailing-edge of the sheet P can be prevented from contacting the front-side guide body 30.

Further, because the spur 31 projects from the connection point 33*c*, shown in FIG. 3, between the second guide face 33*b* and the first guide face 33*a*, the trailing-edge of the sheet P contacts neither the connection point 33*c* nor the vicinity of the connection point 33*c* but the spur 31.

Then, the spur 31 rotates in the same direction as the direction in which the sheet P is transported as the sheet P is transported downstream. At this time, only a small point or small face of the spur 31 contacts the surface of the sheet P on which the unfixed toner image T is formed, and as a result, the image quality is not degraded.

As described above, because the sheet P that is transported to the fixing device 20 contacts the upstream spur 31 or the downstream spur 32, the surface of the sheet P on which the unfixed toner image is formed can be prevented from contacting the surface of the front-side guide member 30.

Consequently, a reduction of the image quality caused by contacting the front-side guide member 30 with the surface of the sheet P on which the unfixed toner image T is formed can be prevented, and it is possible to obtain a high quality image.

If the sheet P is jammed between the guide member 30 and 40, the spurs 31 and 32 may receive pressure from the jammed sheet P. Therefore, in the present embodiment, as described above with reference to FIG. 9, the openings 34 formed in the front-side guide member 30 include the openings for the spurs 31 and 32 on the side of the sheet transport pathway R1. In the other words, a direction in which the spurs 31 and 32 are removed from the openings 34 is opposite a direction in which the spurs 31 and 32 receive a pressure from the jammed sheet P. Therefore, there is no chance that the spurs 31 and 32 come off and drop down by receiving pressure from the jammed sheet P.

Additionally, as described above with reference to FIG. 9, the edges on the upstream side and the downstream side of the opening 34 are respectively formed by the sloped faces 34*a* and 34*b*. Therefore, the opening of the opening 34 is expanded, and inserting the spurs 31 and 32 become easy.

Figure 13:
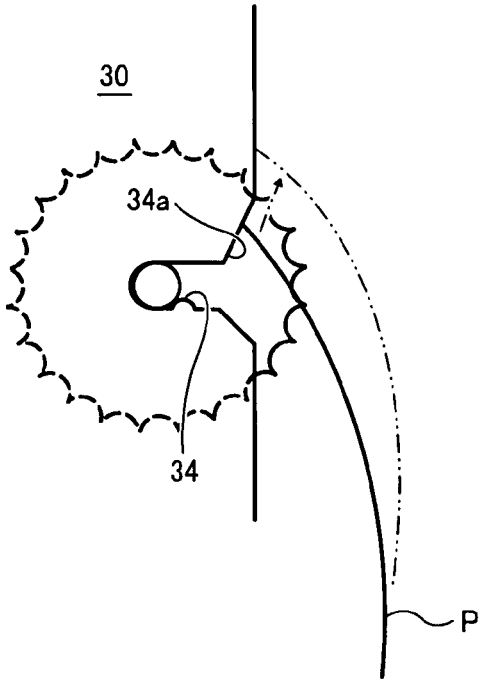
FIG. 13 is a view illustrating movement of a leading-edge of a sheet contacting a sloped face in the opening shown in FIG. 9.

Even when the leading-edge of the sheet P contacts the downstream edge (upper side in FIG. 13) of the opening 34, the leading-edge of the sheet P can smoothly ride over the sloped face 34*a* as indicated by dashed lines shown in FIG. 13, because the downstream edge thereof is formed as the sloped face 34*a*. Consequently, jamming and wrinkling of sheets caused, by the leading-edge of the sheet P getting caught in the opening 34 can be prevented.

Because the fixing device 20 according to the present embodiment is removably installable in the image forming apparatus 1000, the fixing device 20 can be detached from the image forming apparatus 1000 for maintenance. When the removed fixing device 20 is put on a load surface F, such as a table, the two guide members 30 and 40 are used as legs for supporting the fixing device 20 as shown in FIG. 14A.

Figure 14A:
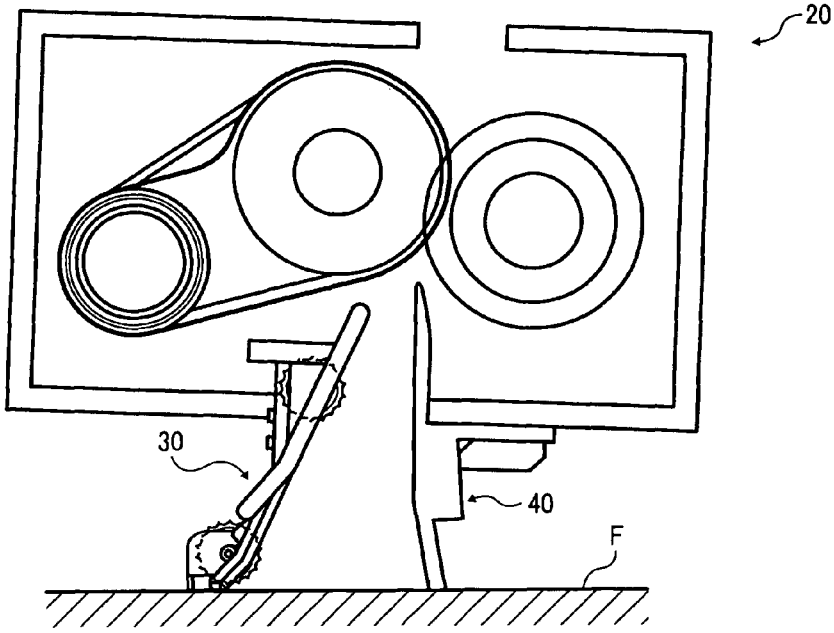
FIG. 14A is a schematic view illustrating a configuration that the fixing device is put on a load surface.
Figure 14B:
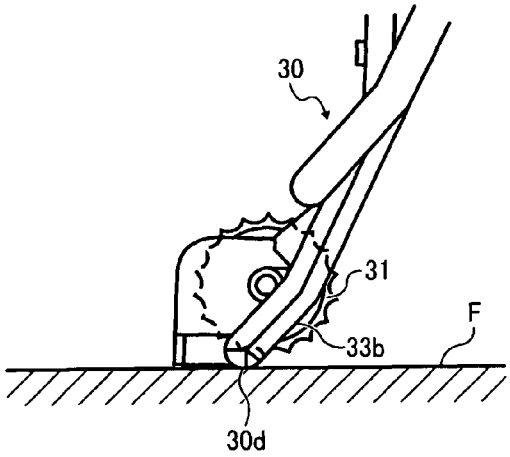
FIG. 14B is an enlarged view illustrating essential portions of the fixing device shown in FIG. 14A.

In FIG. 14B that is an enlarged view illustrating a main portion of the fixing device 20 shown in FIG. 14A, the upstream end portion 33*d* of the second guide face 33*b* is disposed upstream from the upstream spur 31. Therefore, in the state in which the fixing device is put on the load surface F, the upstream end portion 30*d* of the front-side guide member 30 contacts the load surface F and the spur 31 does not contact the load surface F. Consequently, this configuration can prevent the upstream spur 31 from being damaged and thus broken by contacting the load surface F when the fixing device 20 is removed for maintenance.

It is to be noted that, in the present embodiment, the incline angle .θ. between the incline angle of the first guide face 33*a* and the incline angle of the second guide face 33*b* (shown in FIG. 3) is preferably set within a range from 15 degrees to 20 degrees. For example, the incline angle θ in the present embodiment is set to 17 degrees. When the incline angle θ is under the 15 degrees, the trailing-edge of the sheet P may contact the second guide face 33*b*. Therefore, as the incline angle θ increases, the location of the second guide face 33*b* is moved farther away from the trailing-edge of the sheet P, and thus, as the configuration that the incline angle θ is increased, it is more advantageous to avoid damage to the unfixed toner image on the surface of the trailing-edge of the sheet P caused by contacting the second guide face 33*b*.

However, in the present configuration that the fixing device 20 is put on the load face F, as shown in FIG. 14A, the length L in the sheet transport direction of the second guide face 33*b* (shown in FIG. 3) is set so that the upstream end portion 30*d* of the front-side guide member 30 contacts the load surface F and the spur 31 does not contact the load surface F.

Figure 14C:
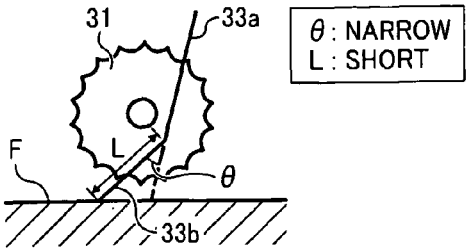
FIGS. 14C and 14D are diagrams illustrating lengths in the sheet transport direction of one guide face of the front-side guide member in accordance with and an incline angle θ between an incline angle of another guide face of the front-side guide member and an incline angle of the one guide the second guide face, as compared with each other.
Figure 14D:
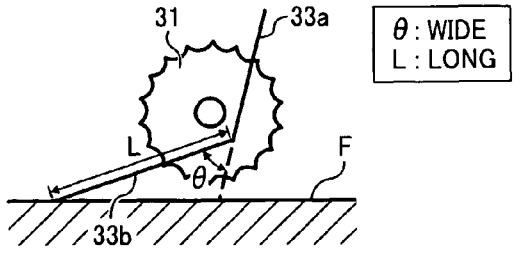

With reference to FIGS. 14C and 14D, a description of the length L is given. As shown in FIG. 14C, when the incline angle θ is narrow, the length L is short. By contrast, as shown in FIG. 14D, when the incline angle θ is wide, the length L is long. That is, the length L is set in accordance with the incline angle θ. For example, when the radius of the spur 31 is 4.8 mm, the length L is 5.4 mm at the incline angle θ of 15 degrees, the length L is 5.6 mm at the incline angle θ of 17 degrees, and the length L is 5.9 mm at the incline angle θ of 19 degrees. As described above, as the incline angle θ increases, the length L becomes long, and the development device 4 increases in size. In order to compact the development device 4, it is desirable for the configuration that the incline angle θ is narrow, and more particularly, closer to 15 degrees. Therefore, considering the tolerance, the incline angle θ is preferably set within above-described range.

Consequently, this configuration can prevent the upstream spur 31 from being damaged and thus broken by contacting the load surface F when the fixing device 20 is removed for maintenance.

Although one embodiment of the fixing device according to the present invention is described above, the fixing device according the present invention is not limited thereto. For example, as described below the present invention is also applicable to the fixing devices shown in FIGS. 15 through 18.

Second Embodiment

Figure 15:
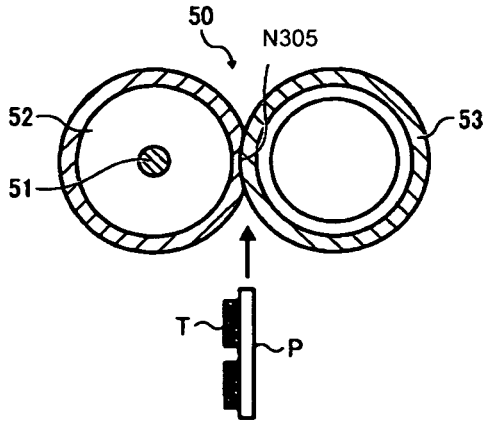
FIG. 15 is a schematic cross-sectional view illustrating a configuration of a fixing device according to another illustrative embodiment of the present invention, in which a fixing roller is used as a rotary fixing member.

In FIG. 15, a fixing device 50 includes a fixing roller 52 inside which a heater 51 is provided, and a pressure roller 53 that contacts the fixing roller 52 with pressure. The fixing device 50 does not include a fixing belt. Instead, the fixing device 50 uses the fixing roller 52 as a rotary fixing member. The fixing roller 52 is rotated by a driving member, not shown, and the pressure roller 53 rotates as the fixing roller 52 rotates.

The toner image T on the sheet P is fixed by passing the sheet P on which an unfixed toner image T is formed through a fixing nip N305 formed between the fixing roller 52 and the pressure roller 53.

Third Embodiment

Figure 16:
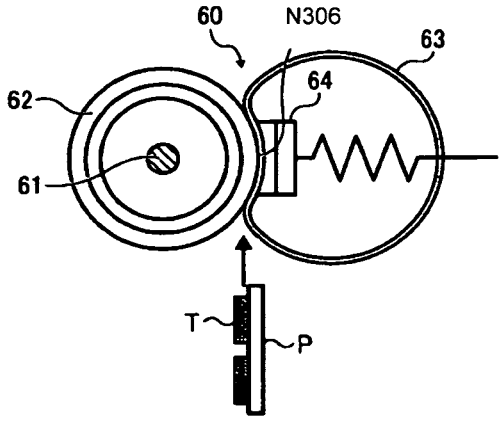
FIG. 16 is a schematic cross-sectional view illustrating a configuration of a fixing device according to another illustrative embodiment of the present invention, in which a pressure belt is used as a rotary pressure member.

In FIG. 16, a fixing device 60 includes a fixing roller 62 inside which a heater 61 is provided, and a pressure belt 63 that is a seamless belt to press the fixing roller 62. The pressure belt serves as a rotary pressure member. The pressure belt 63 is pressed against the fixing roller 62 by a pressure pad 64, and the pressure belt 63 is rotated at a speed similar to the speed at which the fixing roller 62 rotates.

The toner image T on the sheet P is fixed by passing the sheet P on which an unfixed toner image T is formed through a fixing nip N306 formed between the fixing roller 62 and the pressure belt 63.

Fourth Embodiment

Figure 17:
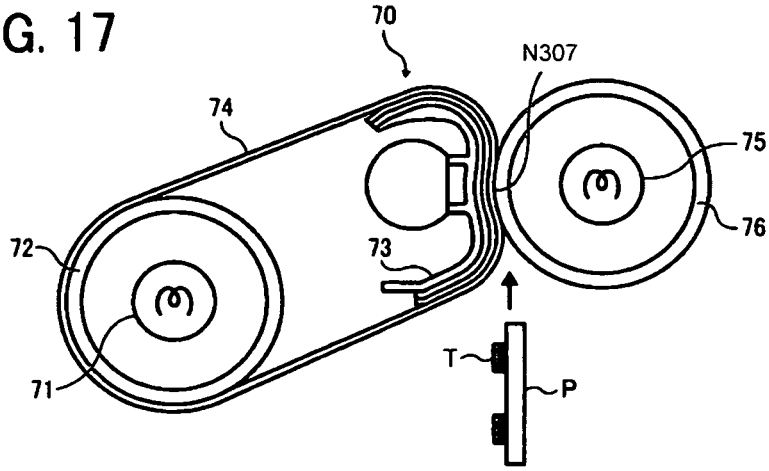
FIG. 17 is a schematic cross-sectional view illustrating a configuration of a fixing device according to another illustrative embodiment of the present invention, in which a fixing pad is provided.

In FIG. 17, a fixing device 70 includes a heating roller 72 inside which a heater 71 is provided, a fixing pad 73, a fixing belt 74 extended around the fixing pad 73 and the heating roller 72, and a pressure roller 76 that includes a heater 75 and contacts the fixing belt 74 in a portion facing the fixing pad 73. As the pressure roller 76 rotates, the fixing belt 74 is rotated.

The toner image T on the sheet P is fixed by passing the sheet P on which an unfixed toner image T is formed through a fixing nip N307 formed between the fixing belt 74 and the pressure roller 76.

Fifth Embodiment

Figure 18:
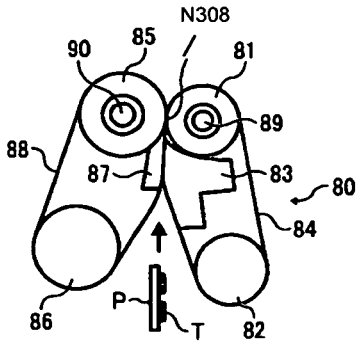
FIG. 18 is a schematic cross-sectional view illustrating a configuration of a fixing device according to another illustrative embodiment of the present invention, in which a fixing belt and a pressure belt are provided.
Figure 19:
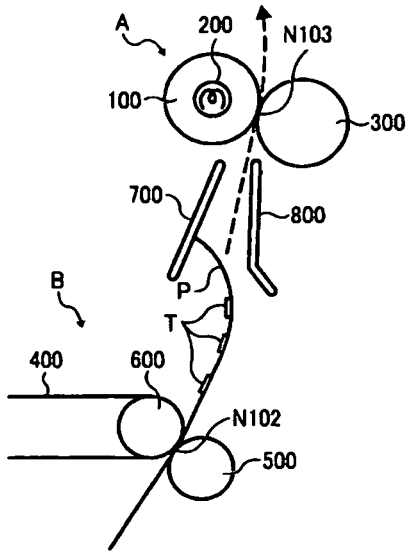
FIG. 19 RELATED ART
FIG. 19 is a schematic diagram illustrating a known fixing device and a transfer mechanism included in an image forming apparatus.
Figure 20:
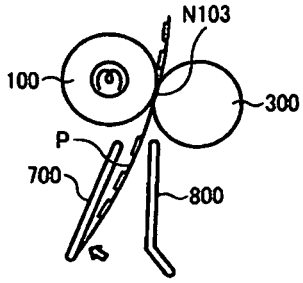
FIG. 20 RELATED ART
FIG. 20 is an end-on cross-sectional view illustrating the action of the fixing device shown in FIG. 19, when the trailing-edge of the sheet contacts a guide member.

In FIG. 18, a fixing device 80 includes a fixing belt 84, serving as a rotary fixing member, extended around rollers 81 and 82 and a guide member 83, and a pressure belt 88, serving as a rotary pressure member, extended around rollers 85 and 86 and a guide member 87.

The fixing belt 84 is rotated by the roller 81 driven by a driving mechanism, not shown. The pressure roller 88 is pressed against the fixing belt 84 by the roller 85 and is rotated at a speed similar to the speed at which fixing belt 84 rotates. Further, the rollers 81 and 85 include respective heaters 89 and 90, and the heaters 89 and 90 heat respectively the fixing belt 84 and the pressure belt 88.

The toner image T on the sheet P is fixed by passing the sheet P on which an unfixed toner image T is formed through a fixing nip N308 formed between the fixing belt 84 and the pressure belt 88.

It is to be noted that although the fixing device according to the present invention is installed in a quadruplet tandem-type indirect transfer multicolor printer in FIG. 1, the fixing devices according to the various embodiments in the present specification can be installed in a direct, transfer-type image forming apparatus 1000 that directly transfers an image formed on an image carriers onto sheets, a revolver-type multicolor image forming apparatus 1000 that sequentially forms respective color toners on one image carrier, or the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a case, including, a rotary fixing member, a heater to heat the rotary fixing member, and a pressure roller that presses against the rotary fixing member to form a fixing nip where the pressure roller presses against the rotary fixing member and through which a recording medium is conveyed to fix an image on the recording medium;

a front-side guide member attached to the case to guide the recording medium transported through a recording media transport pathway to the fixing nip, disposed upstream from the fixing nip in a direction in which the recording medium is transported and facing an unfixed-image side of the recording medium, the front-side guide member including a guide face located on a side of the recording media transport pathway, the guide face including a first guide face and a second guide face, the second guide face being located where at least a trailing edge of the recording medium approaches the front-side guide member as the recording medium is transported through the recording media transport pathway and which is inclined with respect to the first guide face away from the recording media transport pathway;

a back-side guide member attached to the case and being arranged opposite to the front-side guide member to guide the recording medium through the recording media transport pathway, the back-side guide member being disposed upstream from the fixing nip and facing a back-side of the recording medium; and a first spur rotatably provided on the front-side guide member and projecting into the recording media transport pathway from a connection portion between the first guide face and the second guide face, the connection portion including an apex between the first guide face and the second guide face, the first spur having a fixed axis of rotation, and a projection amount of the first spur projecting from the second guide face into the recording media transport pathway such that the projection amount is shorter than a radius of the first spur, an upstream end portion of the front-side guide member being located upstream from the first spur in the direction in which the recording medium is transported, the upstream end portion of the front-side guide member covering a bottommost part of the first spur, wherein the back-side guide member and the front-side guide member extend a distance from an outer surface of the case such that front-side guide member and the back-side guide member support the fixing device when the fixing device is placed on a load surface.

2. The fixing device according to claim 1, wherein a length of the second guide face and an incline angle between the second guide face and the first guide face are set so that a leading-edge of the recording medium does not contact the second guide face.

3. The fixing device according to claim 2, wherein the incline angle between the second guide face and the first guide face is set within a range from 15 degrees to 20 degrees, and the length of the second guide face is set in accordance with the incline angle.

4. The fixing device according to claim 1, further comprising a protection wall located on a side of the front-side guide member opposite the guide face, farther away from the recording media transport pathway than the first spur.

5. The fixing device according to claim 4, wherein the protection wall is connected to the upstream end portion of the front-side guide member so as to cover the bottommost part of the first spur and to contact the load surface when the fixing device is placed on the load surface.

6. The fixing device according to claim 4, wherein the front-side guide member and the back-side guide member extend a same distance from the outer surface of the case.

7. The fixing device according to claim 1, further comprising multiple first spurs, wherein the multiple first spurs are arranged orthogonal to the direction in which the recording medium is transported.

8. The fixing device according to claim 1, wherein the front-side guide member has a first opening into which the first spur is inserted to attach the first spur to the front-side guide member, and the first opening is formed in the second guide face located on the side of the recording media transport pathway.

9. The fixing device according to claim 8, wherein a downstream edge of the first opening formed in the second guide face is sloped at an incline to the recording media transport pathway.

10. The fixing device according to claim 1, wherein the first spur is formed of a heat-resistant resin.

11. The fixing device according to claim 1, further comprising a second spur rotatably located downstream from the first spur in the front-side guide member in the direction in which the recording medium is transported, the second spur projecting from the first guide face into the recording media transport pathway, and the second spur having a fixed axis of rotation.

12. The fixing device according to claim 11, wherein a projection amount of the second spur projecting from the first guide face into the recording media transport pathway is shorter than a radius of the second spur.

13. The fixing device according to claim 11, further comprising multiple second spurs, wherein the multiple second spurs are arranged orthogonal to the direction in which the recording medium is transported.

14. The fixing device according to claim 11, wherein the front-side guide member has a first opening into which the first spur is inserted to attach the first spur to the front-side guide member, and the first opening is formed in the second guide face located on the side of the recording media transport pathway; and a second opening into which the second spur is inserted to attach the second spur to the front-side guide member, and the second opening is formed in the first guide face located on the side of the recording media transport pathway.

15. The fixing device according to claim 14, wherein a downstream edge of the second opening formed in the first guide face is sloped at an incline to the recording media transport pathway.

16. The fixing device according to claim 11, wherein the second spur is formed of a heat-resistant resin.

17. An image forming apparatus comprising:

an image carrier to carry a latent image on its surface;

a charging mechanism to electrically charge the surface of the image carrier;

an exposure mechanism to expose the surface of the image carrier to form the latent image;

a development mechanism to form a visible image by supplying toner to the latent image formed on the surface of the image carrier;

a transfer mechanism to transfer the visible image formed on the surface of the image carrier onto a recording medium; and a fixing device to fix a transfer image transferred onto the recording medium, the fixing device comprising, a case including, a rotary fixing member, a heater to heat the rotary fixing member, and a pressure roller that presses against the rotary fixing member to form a fixing nip where the pressure roller presses against the rotary fixing member and through a recording medium is conveyed to fix an image on the recording medium, a front-side guide member attached to the case to guide the recording medium transported through a recording media transport pathway to the fixing nip, disposed upstream from the fixing nip in a direction in which the recording medium is transported and facing an unfixed-image side of the recording medium, the front-side guide member including a guide face located on a side of the recording media transport pathway, the guide face including a first guide face and a second guide face, the second guide face being located where at least a trailing-edge of the recording medium approaches the front-side guide member as the recording medium is transported through the recording media transport pathway and which is inclined with respect to the first guide face away from the recording media transport pathway, a back-side guide member attached to the case and being arranged opposite to the front-side guide member to guide the recording medium through the recording media transport pathway, the back-side guide member being disposed upstream from the fixing nip and facing a back-side of the recording medium, and a first spur rotatably provided on the front-side guide member and projecting into the recording media transport pathway from a connection portion between the first guide face and the second guide face, the connection portion including an apex between the first guide face and the second guide face, the first spur having a fixed axis of rotation, and a projection amount of the first spur projecting from the second guide face into the recording media transport pathway such that the projection amount is shorter than a radius of the first spur, an upstream end portion of the front-side guide member being located upstream from the first spur in the direction in which the recording medium is transported, the upstream end portion of the front-side guide member covering a bottommost part of the first spur, wherein the back-side guide member and the front-side guide member extend a distance from an outer surface of the case such that the front-side guide member and the back-side guide member support the fixing device when the fixing device is placed on a load surface.

18. The image forming apparatus according to claim 17, wherein the fixing device further comprises a second spur rotatably located downstream from the first spur in the front-side guide member in the direction in which the recording medium is transported, the second spur projecting from the first guide face into the recording media transport pathway, the second spur having a fixed axis of rotation.

19. The fixing device according to claim 17, wherein the front-side guide member and the back-side guide member extend a same distance from the outer surface of the case.

* * * * *